US009024849B2

(12) United States Patent
Kawano

(10) Patent No.: US 9,024,849 B2
(45) Date of Patent: May 5, 2015

(54) DISPLAY APPARATUS, DRIVING APPARATUS FOR LIGHT-EMITTING DEVICES, AND IMAGE FORMING APPARATUS

(71) Applicant: Canon Kabushiki Kaisha, Tokyo (JP)

(72) Inventor: Fujio Kawano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 13/866,565

(22) Filed: Apr. 19, 2013

(65) Prior Publication Data

US 2013/0278587 A1 Oct. 24, 2013

(30) Foreign Application Priority Data

Apr. 23, 2012 (JP) ..... 2012-098112
Feb. 28, 2013 (JP) ..... 2013-039270

(51) Int. Cl.
*G09G 3/30* (2006.01)
*G09G 3/32* (2006.01)

(52) U.S. Cl.
CPC ..... *G09G 3/3233* (2013.01); *G09G 2300/0852* (2013.01); *G09G 2300/0861* (2013.01); *G09G 2320/0295* (2013.01)

(58) Field of Classification Search
USPC ..... 345/76–83, 87–100, 204; 315/169.1–169.4
See application file for complete search history.

(56) References Cited

U.S. PATENT DOCUMENTS

2003/0030603 A1 2/2003 Shimoda

FOREIGN PATENT DOCUMENTS

| | | | |
|---|---|---|---|
| CN | 1975847 | A | 6/2007 |
| CN | 201199425 | Y | 2/2009 |
| CN | 101515434 | A | 8/2009 |
| WO | 98/48403 | A1 | 10/1998 |

*Primary Examiner* — Pegeman Karimi
(74) *Attorney, Agent, or Firm* — Canon USA, Inc., IP Division

(57) ABSTRACT

A driving apparatus for light-emitting devices includes transistors, data lines connected to gates of the transistors, feedback lines connected to a source or a drain of the transistors that supply a current to the light-emitting devices, a voltage amplifier that includes an input terminal connected to the feedback line and an output terminal connected to the data line, and a data generation circuit connected to the input terminal of the voltage amplifier through a capacitor. The voltage amplifier converts a change in voltage of the feedback line generated by a current flowing from the transistors to the capacitor into a change in voltage of the data line in a direction in which the transistors connected to the data line turn off.

12 Claims, 9 Drawing Sheets

DISPLAY APPARATUS, DRIVING APPARATUS FOR LIGHT-EMITTING DEVICES, AND IMAGE FORMING APPARATUS

BACKGROUND OF THE INVENTION

1. Field of the Invention

The present invention relates to a display apparatus, a driving apparatus for light-emitting devices, and an image forming apparatus, and, more particularly, to a display apparatus including organic electroluminescent (EL) devices and driving circuits for the organic electroluminescent devices.

2. Description of the Related Art

Light-emitting devices that utilize the electroluminescence of an organic compound are arranged in a matrix and used in a display apparatus. In an active matrix display apparatus, a driving circuit is provided for each pixel, and supplies current according to data voltage to each organic EL device. At this time, because the threshold voltage of a driving transistor included in each driving circuit is not the same, there is a problem in that the current supplied to the organic EL device varies between the pixels.

In International Publication No. WO 98/48403, a driving circuit that generates current independent of the threshold voltage of a driving transistor is disclosed in FIG. 3. Prior to writing of data voltage, a current path between the driving transistor and an organic EL device is blocked, and a gate and a drain are short-circuited to each other. In doing so, the drain current of the driving transistor discharges a gate-source capacitor, thereby decreasing gate-source voltage. When the gate-source voltage becomes equal to the threshold voltage of the driving transistor, the drain current becomes zero. Therefore, the capacitor holds the threshold voltage. Such an operation for setting the gate-source voltage to the threshold voltage of a transistor using current flowing through the transistor is called an auto-zero operation.

In order to write data voltage to a driving circuit in which the threshold voltage is held by a gate-source capacitor of a driving transistor as a result of the auto-zero operation, a change in the voltage of a data line is transmitted to the gate of the driving transistor through another capacitor connected between the gate and the data line. When the voltage of the data line is changed from reference voltage at the time of the auto-zero operation to the data voltage, voltages at both ends of the gate-source capacitor change from the threshold voltage by a voltage proportionate to the change in the voltage of the data line. The gate-source voltage after the change has a value obtained by adding the change proportionate to the data voltage to the threshold voltage. Therefore, drain current independent of the threshold voltage may be obtained.

In U.S. Patent Application Publication No. 2003/0030603, a driving circuit for a light-emitting device that uses an operational amplifier and that obtains driving voltage independent of a threshold is disclosed.

The luminance signal voltage for the light-emitting device is determined as one input of the operational amplifier, and the voltage of the light-emitting device connected to a source or a drain of a driving transistor is determined as another input of the operational amplifier as a feedback signal. An output of the operational amplifier is connected to a gate of the driving transistor. Because of the operation of the operational amplifier, the voltage of the light-emitting device may become the same as the luminance signal voltage regardless of the threshold voltage of the driving transistor. However, it is extremely difficult to configure a feedback loop using a data line and a feedback line and to cause the operational amplifier to stably perform a feedback operation. Because the data line and the feedback line have relatively large capacitance and resistance components, it takes time to achieve a stable point. In addition, because the data line and the feedback line have inductance, there is a problem in that oscillation is likely to occur.

SUMMARY OF THE INVENTION

In order to solve the above problem, a first aspect of the present invention provides a display apparatus including light-emitting devices and driving circuits for supplying current to the light-emitting devices configured to be arranged in a row direction and a column direction, data lines and feedback lines configured to be provided for columns of the driving circuits, a row control circuit configured to control the driving circuits row by row, and a column control circuit configured to supply voltage to the data lines. Each of the driving circuits includes a transistor that supplies current to each of the light-emitting devices, a first switch that connects a gate of the transistor and one of the data lines, a second switch that connects a drain or a source of the transistor and one of the feedback lines, and a third switch that connects the drain or the source of the transistor and each of the light-emitting devices, where the first, second and third switches are controlled by the row control circuit. The column control circuit includes a data generation circuit, a non-inverting voltage amplifier whose input terminal is connected to the data generation circuit through a capacitor and output terminal is connected to one of the data lines, and whose voltage at the output terminal is determined by a voltage at the input terminal, and a fourth switch that connects the input terminal of the voltage amplifier and one of the feedback lines.

A second aspect of the present invention provides a method for driving a light-emitting device that uses a transistor, one of a source and a drain of which is connected to a power source and another of which supplies current to the light-emitting device, and a non-inverting voltage amplifier that outputs voltage determined by voltage at an input terminal. The method includes a first step in which a threshold voltage of the transistor is set between a gate and the source of the transistor by connecting the source or the drain of the transistor that supplies the current to the light-emitting device to an end of a capacitor to supply a current from the transistor to the capacitor and transferring a voltage of the capacitor to the gate of the transistor through the non-inverting voltage amplifier until the current becomes zero, a second step in which the threshold voltage set between the gate and the source of the transistor is changed according to data voltage by disconnecting the transistor from the end of the capacitor and applying the data voltage to another end of the capacitor, and a third step in which the light-emitting device is caused to light at luminescence according to the data voltage by connecting the source or the drain of the transistor to the light-emitting device, and supplying the current flowing through the transistor to the light-emitting device.

A third aspect of the present invention provides a driving apparatus for light-emitting devices. The driving apparatus includes a plurality of transistors configured to be arranged in a row direction and a column direction, each of the plurality of transistors including a source and a drain, one of which is connected to a power supply and another of which supplies current to each of the light-emitting devices, data lines configured to be provided for the plurality of transistors in the column direction in common and connected to gates of the transistors through first switches, feedback lines configured to be provided for the plurality of transistors in the column direction in common and connected to the source or the drain of the transistors that supplies the current to each of the light-emitting devices through second switches, third switches configured to connect the source or the drain of the transistors to the light-emitting devices to supply currents, a voltage amplifier, an input terminal of which is connected to one of the feedback lines through a fourth switch and an output terminal of which is connected to one of the data lines, and a data generation circuit configured to be connected to the input terminal of the voltage amplifier via a capacitor connected in series. The voltage amplifier is a non-inverting voltage amplifier to transfer a change in voltage at the input terminal to the output terminal without changing polarity, and converts a change in voltage of the corresponding feedback line generated by a current flowing from the transistors to the capacitor through the second switches into a change in voltage of the corresponding data line in a direction in which the transistors connected to the data line through the first switches turn off.

According to the present invention, it is possible to stabilize the operation of a driving circuit for a light-emitting device that feeds back the output voltage of a driving transistor to a gate of the driving transistor using an operational amplifier.

Further features of the present invention will become apparent from the following description of exemplary embodiments with reference to the attached drawings.

DESCRIPTION OF THE EMBODIMENTS

Figure 1:
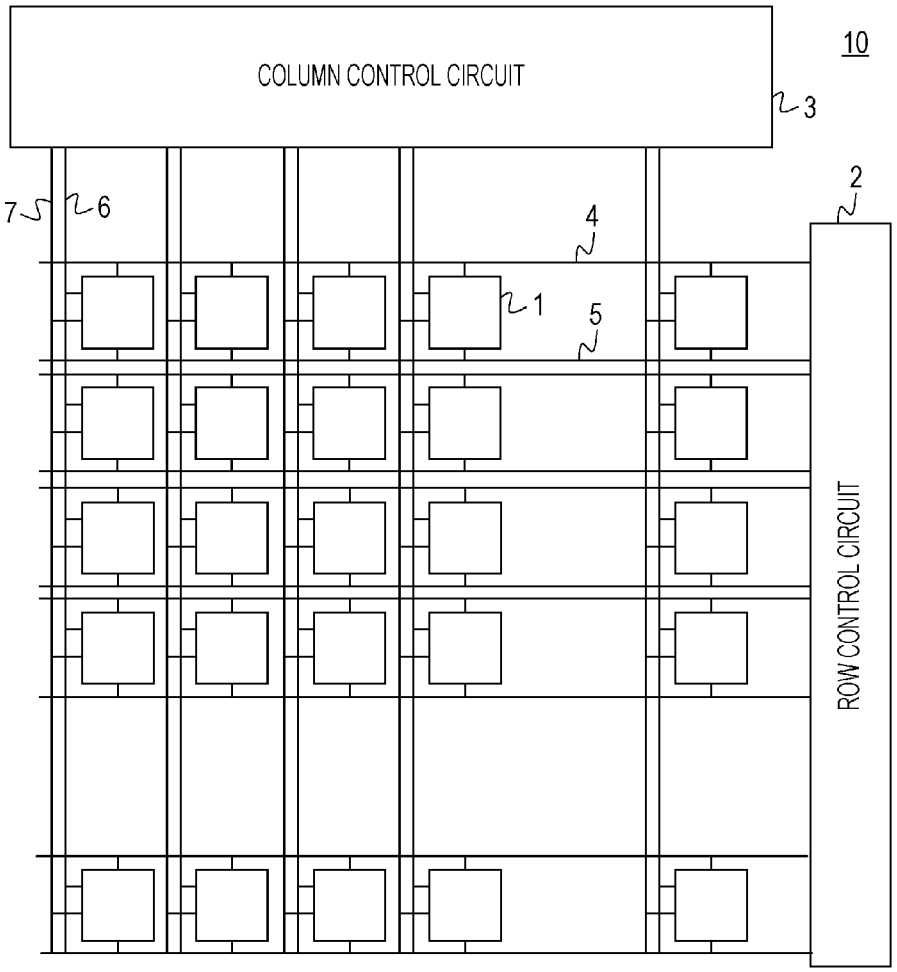
FIG. 1 is a block diagram illustrating the configuration of a display apparatus according to a first embodiment of the present invention.

FIG. 1 is a block diagram illustrating the configuration of a display apparatus according to a first embodiment of the present invention.

A matrix display apparatus 10 operates using a plurality of pixels 1 arranged in a row direction and a column direction. Each pixel 1 includes a light-emitting device such as an organic EL device and a pixel circuit that drives the light-emitting device. In a display apparatus capable of realizing color display, three types of light-emitting devices, namely red (R), green (G), and blue (B), are alternately arranged in the row direction.

The pixels 1 are controlled by scan lines 4 and light emission control lines 5 that extend in the row direction and data lines 6 and feedback lines 7 that extend in the column direction. A row control circuit 2 supplies signals to the scan lines 4 and the light emission control lines 5 in order to cause the pixels 1 to enter a write mode, a light-emitting mode, or the like. A column control circuit 3 generates data signals that determine the light-emitting states of the pixels 1, and writes the data signals to the pixels 1 in the write mode through the data lines 6. In the light-emitting mode, the pixels 1 emit light in accordance with written luminance signals.

Figure 2:
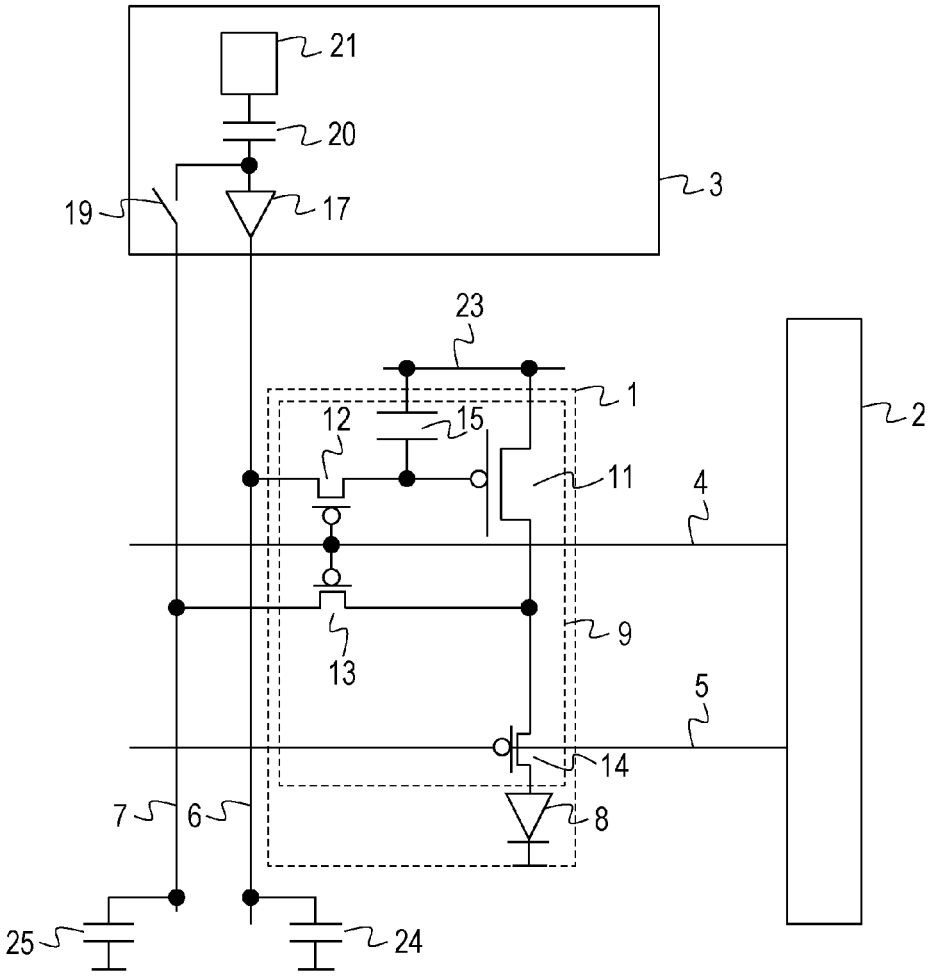
FIG. 2 is a circuit diagram illustrating details of the first embodiment.

FIG. 2 is a diagram illustrating details of the pixel circuit and connection of the data line 6 and the feedback line 7 to the column control circuit 3 in one column of the matrix display apparatus 10 illustrated in FIG. 1. The same components as those illustrated in FIG. 1 are given the same reference numerals.

A driving circuit 9 includes four p-channel field-effect transistors 11, 12, 13, and 14 and a pixel capacitor 15 for holding data voltage. In addition to the scan line 4, the light emission control line 5, the data line 6, and the feedback line 7, a power supply line 23, which is omitted in FIG. 1, is connected to the driving circuit 9.

One end of the pixel capacitor 15 and a source of the transistor 11 are connected to the power supply line 23. A drain of the transistor 11 outputs current determined by gate-source voltage held by the pixel capacitor 15, and supplies the current to a light-emitting device 8 through the transistor 14. The transistor 11 will be referred to as a driving transistor hereinafter.

The transistor 12 arranged between the data line 6 and the driving transistor 11 is a switch for transmitting the voltage of the data line 6 to a gate of the driving transistor 11. The transistor 12 will be referred to as a first switch hereinafter. The transistor 13 arranged between the feedback line 7 and the drain of the driving transistor 11 is a switch for causing the drain current of the driving transistor 11 to flow into the feedback line 7 while the transistor 12 is turned off. The transistor 13 will be referred to as a second switch hereinafter. The transistors 12 and 13 are controlled by control signals supplied to the same scan line 4.

The transistor 14 is switched between two states, namely conductive and nonconductive, by a signal from the light emission control line 5, and serves as a switch for supplying driving current generated by the driving transistor 11 to the EL device or blocking the driving current. The transistor 14 will be referred to as a third switch hereinafter.

The column control circuit 3 includes two circuit blocks 17 and 21, a switch 19, and a capacitor 20. The circuit block 21 is a data generation circuit that generates data voltage, and the circuit block 17 is a voltage amplifier. The capacitor 20 is a coupling capacitor that transmits the output of the data generation circuit 21 to the voltage amplifier 17.

The data voltage generated by the data generation circuit 21 is output to the data line 6 through the coupling capacitor 20 and the voltage amplifier 17.

Figure 3:
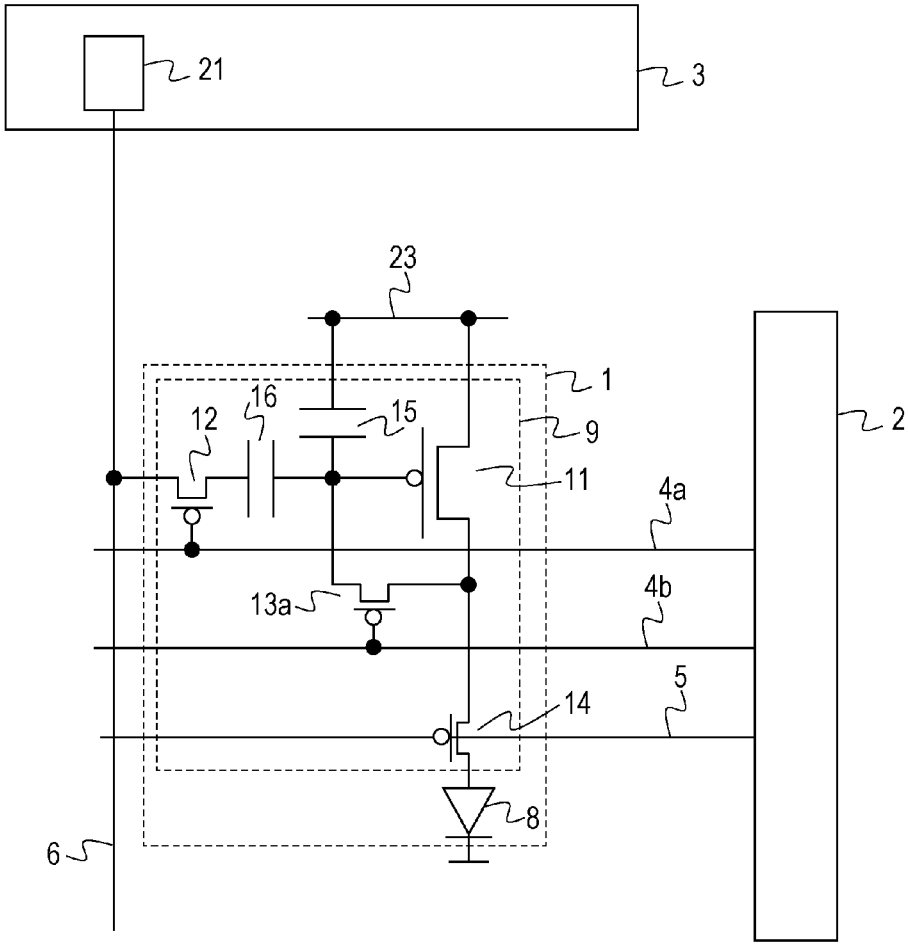
FIG. 3 is a diagram illustrating a pixel and a column control circuit according to an example of the related art.
Figure 4:
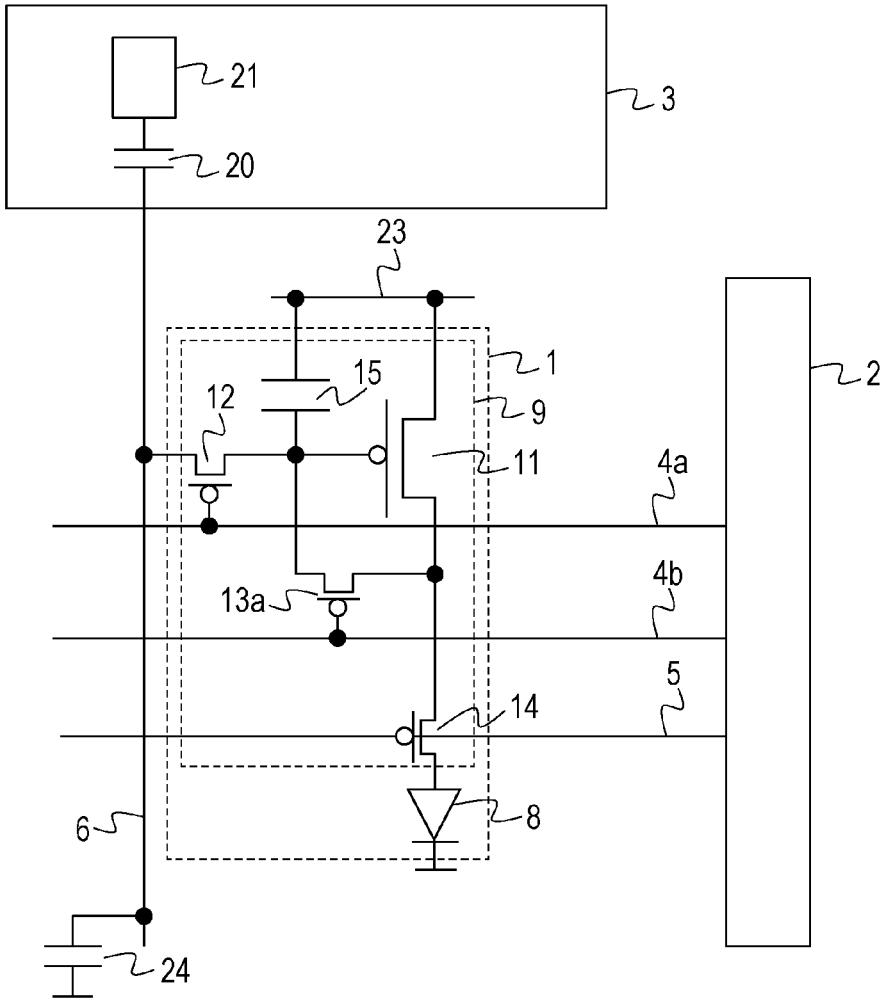
FIG. 4 is a diagram illustrating the display apparatus according to the example of the related art in which the position of a coupling capacitor has been changed.

FIGS. 3 and 4 are diagrams illustrating differences between display apparatuses according to examples of the related art and the display apparatus in the present invention. FIG. 3 illustrates a pixel circuit and a column control circuit in a display apparatus according to an example of the related art disclosed in International Publication No. WO 98/48403, and FIG. 4 illustrates a pixel circuit and a column control circuit in a display apparatus obtained by modifying a part of the display apparatus illustrated in FIG. 3.

In the display apparatus according to the example of the related art, a driving circuit 9 includes two capacitors, namely a capacitor 15 between a gate and a source and a capacitor 16 between the gate and a data line 6. The capacitor 15 is a holding capacitor for holding data voltage, and the capacitor 16 is a coupling capacitor for transmitting the voltage of the data line 6 to the driving circuit 9. The data voltage is generated by a data generation circuit 21 in a column control circuit 3, and transmitted to the driving circuit 9 through the data line 6.

The operation of the driving circuit 9 is described in detail in International Publication No. WO 98/48403. In short, first, the gate-source capacitor 15 of the driving transistor 11 holds a threshold voltage through an auto-zero operation while the data line 6 is set to reference voltage. Thereafter, when the voltage of the data line 6 has been switched to data voltage, a change in voltage is transmitted to the gate of the driving transistor 11 through the coupling capacitor 16. As a result, voltage proportionate to the data voltage is added to the threshold voltage held by the pixel capacitor 15, and the driving transistor 11 outputs current independent of the threshold voltage in a saturation region as drain current.

FIG. 4 illustrates a column control circuit 3 including the coupling capacitor 16 of the driving circuit 9 illustrated in FIG. 3 has been moved to a column control circuit 3 as a coupling capacitor 20. One end of the coupling capacitor 20 is connected to an output terminal of a data generation circuit 21, and another end of the coupling capacitor 20 is connected to a data line 6.

The coupling capacitor 20 is provided for each column of the column control circuit 3, and all pixels 1 connected to the same data line 6 share the coupling capacitor 20. The driving circuit 9 includes only a pixel capacitor 15 that holds data voltage, and accordingly the occupied area is significantly smaller than that of the pixel circuit illustrated in FIG. 3.

However, the following problem arises when the display apparatus illustrated in FIG. 4 is to be actually formed on a substrate.

Not only the single driving circuit 9 but also other pixel circuits in the same column are connected to the data line 6. The pixel circuits other than the driving circuit 9 that is in the write mode are electrically disconnected from the data line 6, and do not affect an operation for writing data to the selected driving circuit 9. However, even in the disconnected pixels, the parasitic capacitance of transistors is connected to the data line 6, and parasitic capacitance is also generated at intersections between first and second scan lines 4*a* and 4*b* and a light emission control line 5 and the data line 6. Because the parasitic capacitance varies depending on the shapes of the transistors, the thickness and the permittivity of an insulating film provided between the scan lines 4*a* and 4*b* and the data line 6, and the like, it is difficult to achieve a constant value.

The output of the data generation circuit 21 decreases by a coefficient Cc/(Cc+Cst+Cgs) by passing through the coupling capacitor 20. Cc denotes the capacitance of the coupling capacitor 20, Cst denotes the capacitance of a parasitic capacitor 24 of the data line 6, and Cgs denotes the capacitance of the pixel capacitor 15 of the driving circuit 9. Because the capacitance of the parasitic capacitor 24 (Cst) is incomparably larger than that of the capacitor 15 (Cgs) of the pixel circuit, the voltage of the data line 6 is affected by the parasitic capacitance Cst. As described above, since the value of Cst varies, the output of the data generation circuit 21 is not accurately transmitted to the data line 6.

In order to solve this problem, the display apparatus illustrated in FIG. 2 includes the voltage amplifier 17 between the coupling capacitor 20 and the data line 6.

In the column control circuit 3 illustrated in FIG. 2, the output of the data generation circuit 21 is transmitted to the data line 6 through the coupling capacitor 20 and the voltage amplifier 17 connected in series with each other. In addition, the feedback line 7 is provided parallel to the data line 6. A transistor 13*a* illustrated in FIGS. 3 and 4 provided as a second switch that short-circuits the gate and a drain of the driving transistor 11 is replaced by the transistor 13 provided between the drain of the driving transistor 11 and the feedback line 7. The transistor 13 is controlled by the scan line 4 that also controls the transistor 12, which is the first switch. The feedback line 7 is connected to the drain of the driving transistor 11 by the transistor 13, which is the second switch, and to an input terminal of the voltage amplifier 17 by the switch 19 in the column control circuit 3. The switch 19 will be referred to as a fourth switch hereinafter.

The voltage amplifier 17 decreases output impedance to the data line 6. The output impedance is a ratio of a change in the voltage of the data line 6 to a change in current supplied to the data line 6 from an output terminal of the voltage amplifier 17. The ideal output impedance of the voltage amplifier 17 is zero, and, in this case, the voltage amplifier 17 outputs a constant voltage to the data line 6 in accordance with input voltage, regardless of the current supplied to the data line 6. By providing the voltage amplifier 17, even if the data line 6 includes the parasitic capacitance Cst, the data voltage output from the data generation circuit 21 may be accurately transmitted to the data line 6.

The auto-zero operation is performed when the first switch (transistor 12), the second switch (transistor 13), and the fourth switch 19 have been turned on and the third switch (transistor 14) has been turned off.

At this time, the drain current of the driving transistor 11 charges the coupling capacitor 20 and a parasitic capacitor 25 of the feedback line 7, and increases the voltage of the feedback line 7. The voltage is transmitted to the gate of the driving transistor 11 by the voltage amplifier 17, and the gate voltage increases. The drain current decreases as the gate voltage increases, and becomes substantially zero when the gate-source voltage of the driving transistor 11 becomes close to the threshold voltage.

When the auto-zero operation is complete, the gate voltage of the driving transistor 11 has a potential lower than the source potential, that is, the voltage of the power supply line 23, by the threshold voltage. Therefore, the feedback line 7 has a potential according to the gate voltage of the driving transistor 11, and the coupling capacitor 20 holds a voltage according to a threshold voltage Vth.

Assume that the input impedance of the voltage amplifier 17 is significantly higher than the load impedance of the coupling capacitor 20 connected to the drain of the driving transistor 11, the capacitance of the parasitic capacitor 25 of the feedback line 7, and the like, and the current flowing to the input terminal of the voltage amplifier 17 may be regarded as substantially zero. In addition, assume that the output impedance of the voltage amplifier 17 is significantly small, and the output voltage of the voltage amplifier 17 hardly changes due to current flowing to the data line 6 in order to, for example, charge the parasitic capacitor 25. These conditions are the same as conditions required when a normal voltage amplifier is used, and a voltage amplifier that satisfies these conditions may be created using a known circuit technique.

If the gain of the voltage amplifier 17 is denoted by a, the relationship between voltage Vin at the input terminal and voltage Vout at the output terminal may be expressed as $Vout=\alpha\times Vin$.

In the circuit illustrated in FIG. 2, the gain is supposed to have a positive value, so that the gate voltage becomes higher as the drain voltage increases. That is, the voltage amplifier 17 is a non-inverting voltage amplifier. However, the absolute value of the gain need not be large, and may be 1 or smaller.

The voltage amplifier 17 may be configured by using an operational amplifier. Normally, the output of a voltage amplifier circuit that uses an operational amplifier does not become zero even if the input voltage is zero, and is accompanied by an offset. If the offset voltage of the voltage amplifier 17 is denoted by Voffset, the relationship between the voltage Vin at the input terminal and the voltage Vout at the output terminal is expressed as $Vout=\alpha\times Vin+Voffset$.

Figure 5A:
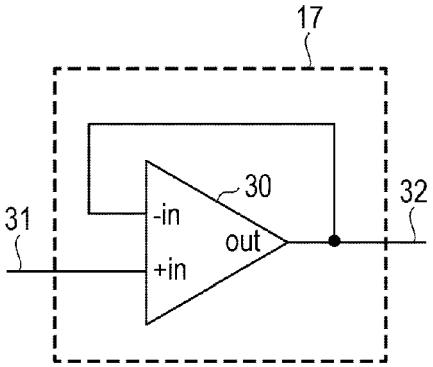
FIGS. 5A and 5B illustrate examples of the configuration of a voltage amplifier according to the first embodiment.
Figure 5B:
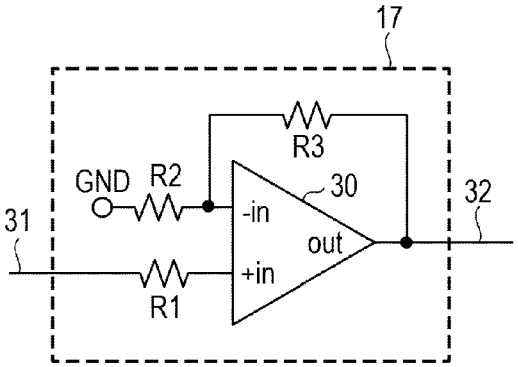

FIGS. 5A and 5B illustrate specific examples of the non-inverting amplifier.

FIG. 5A illustrates a circuit in which a positive input (+in) of an operational amplifier 30 is determined as an input terminal 31 of the non-inverting amplifier, and a negative input (−in) and an output (out) of the operational amplifier 30 are short-circuited to each other and determined as an output terminal 32 of the non-inverting amplifier. In such a circuit, voltage at the output terminal always equals voltage at the input terminal, which is why the circuit is called a "voltage follower circuit".

FIG. 5B illustrates another example of the non-inverting amplifier. An input terminal 31 is connected to a positive input (+in) of an operational amplifier 30 through a resistor R1 connected in series. A negative input (−in) of the operational amplifier 30 is connected to reference voltage GND through a resistor R2 and to an output (out) of the operational amplifier 30 through a resistor R3. The output (out) of the operational amplifier 30 serves as an output terminal 32 of the non-inverting amplifier. In this circuit, the voltage Vout at the output terminal is (1+R3/R2) times as high as the voltage Vin at the input terminal. When the voltage Vin increases, the voltage Vout also increases, and when the voltage Vin decrease, the voltage Vout also decreases. That is, this is a non-inverting amplifier whose gain is (1+R3/R2). When the resistance of the resistor R3 is smaller than that of the resistor R2 and the gain becomes close to 1, the operation can become stable.

The non-inverting amplifiers illustrated in FIGS. 5A and 5B each include a negative feedback loop, so that unexpected oscillation or drift is not generated, and therefore the operations thereof become stable. In FIG. 5A, a line connecting the negative input −in and the output of the operational amplifier 30 configures the negative feedback loop. Even if the voltage Vout at the output terminal temporarily increases due to an external factor, the increase in the voltage Vout at the output terminal may be suppressed due to the voltage at the negative input increases because of the negative feedback loop and therefore the output voltage of the operational amplifier 30 becomes small. In FIG. 5B, the resistor R3 connecting the negative input −in and the output of the operational amplifier 30 configures the negative feedback loop.

Figure 6:
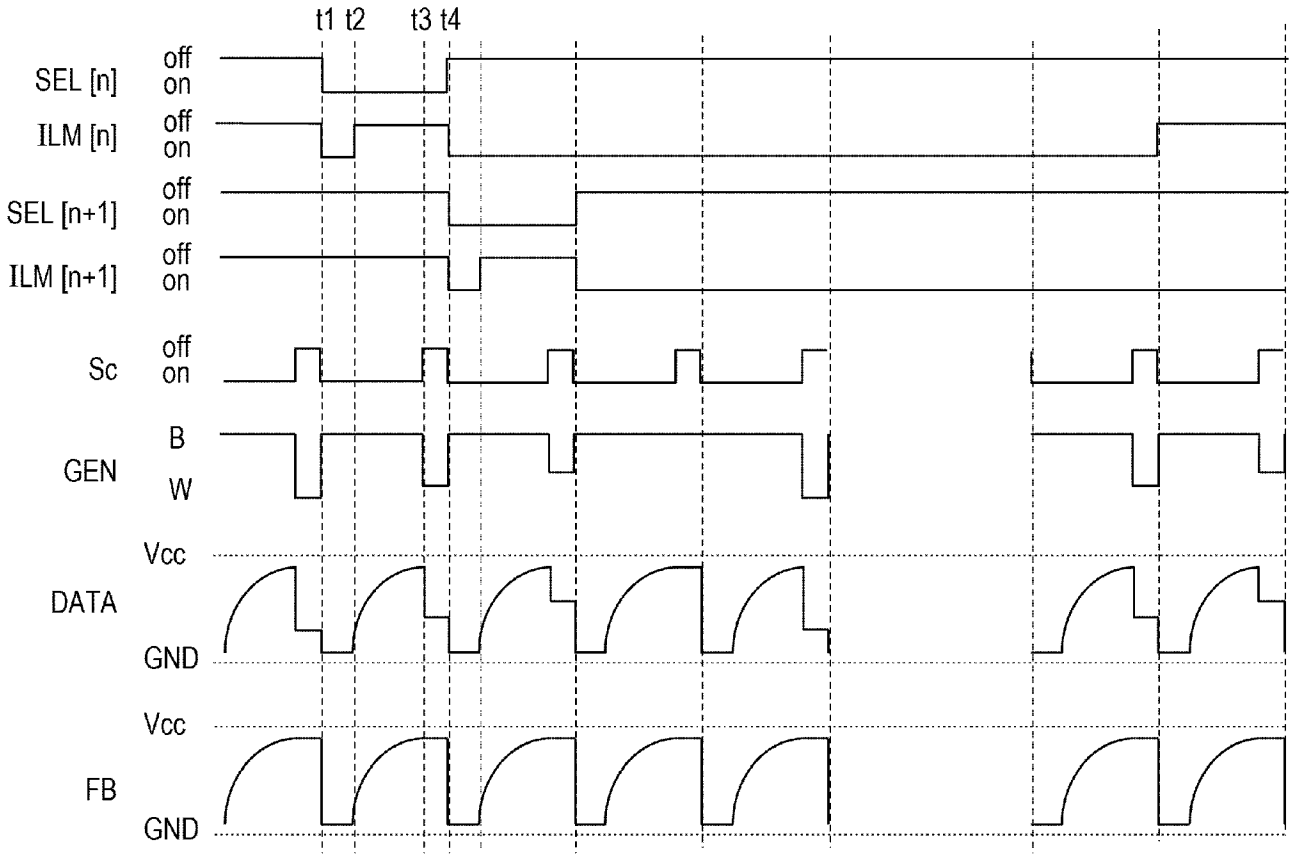
FIG. 6 is a timing chart illustrating the operation of the display apparatus according to the first embodiment.

FIG. 6 is a timing chart illustrating the operation of the circuit illustrated in FIG. 2.

SEL[n] denotes a control signal of the scan line 4 in an n-th row, and ILM[n] denotes a control signal applied to the light emission control line 5 in the n-th row. When SEL[n] switches to a low (L) level, the first switch (transistor 12) and the second switch (transistor 13) of the driving circuit 9 in that row turn on. At the L level, ILM[n] turns on the third switch (transistor 13), and causes current to flow into the organic EL device 8.

Sc denotes a control signal for controlling the fourth switch 19 (transistor 14) of the column control circuit 3. At the L level, the fourth switch turns on. GEN denotes the output voltage of the data generation circuit 21, DATA denotes the voltage of the data line 6, and FB denotes the voltage of the feedback line 7.

The scan lines 4 sequentially switch to the L level row by row, and the pixel circuit in each row that has switched to the L level enters the write mode. A period t1 to t4 is a period in which the pixel circuit in the n-th row is in the write mode. The write mode period t1 to t4 may be divided into a pre-charge period t1 to t2, an auto-zero period t2 to t3, and a data write period t3 to t4.

During the pre-charge period t1 to t2, SEL, ILM, and Sc are all at the L level, and accordingly the first switch (transistor 12), the second switch (transistor 13), and the third switch (transistor 14) of the driving circuit 9 all turn on. The fourth switch of the column control circuit 3 also turns on.

The pre-charge period t1 to t2 is a period for initializing the driving transistor 11 to the conductive state. The drain current of the driving transistor 11 flows into the organic EL device 8, and the drain voltage applies the gate voltage of the driving transistor 11 through the voltage amplifier 17. When the gain of the voltage amplifier 17 is 1 and the offset is zero, the drain and the gate of the driving transistor 11 are essentially short-circuited to each other, and a conductive state in which the gate-source voltage is sufficiently higher than the threshold is established. When the gain is larger than 1, the gate voltage becomes higher than the drain voltage and the variable range of the drain current becomes smaller, but the drain current may be in a range in which the driving transistor 11 is in the conductive state. The same holds true for the offset.

During the pre-charge period t1 to t2, the output GEN of the data generation circuit 21 remains at a constant voltage independent of data, and does not affect the data line 6 at all.

In the auto-zero period t2 to t3, SEL and Sc remain at the L level, but ILM switches to a high (H) level, which turns off the transistor 14 (third switch). The transistor (first switch), the transistor 13 (second switch), and the fourth switch 19 remain turned on. The data generation circuit 21 outputs the same constant voltage Vref as in the pre-charge period t1 to t2.

Because the driving transistor 11 is in the conductive state immediately after the beginning of the auto-zero operation (immediately after the time t2), the drain current flows into the feedback line 7 through the transistor 13, charges the coupling capacitor 20, and causes the voltage of the feedback line 7, whose potential has been sufficiently lower than the power supply voltage at the time t2, to increase. The voltage of the feedback line 7 is transmitted to the data line 6 by the voltage amplifier 17, and the voltage of the data line 6, that is, the gate voltage of the driving transistor 11, increases. Increases in the voltage of DATA and FB from t2 to t3 illustrated in FIG. 6 indicate these changes.

When the gate-source voltage becomes close to the threshold voltage, the drain current becomes small, and accordingly a change in the gate voltage becomes more gradual. It takes infinite time to make the gate-source voltage strictly the same as the threshold voltage, but, in practice, when the drain current has become so small that the drain current may be regarded as zero (time t3), Sc is switched to the H level to turn off the switch 19. The auto-zero period t2 to t3 then ends.

As described above, since the voltage of the feedback line 7 increases while the current is flowing into the driving transistor 11 and the coupling capacitor 20 is being charged, the gate voltage increases, so that the driving transistor 11 becomes close to off in accordance with the increase in the voltage of the feedback line 7. This is why the non-inverting voltage amplifier 17 is used. When the gate-source voltage has reached the threshold voltage, the current of the driving transistor 11 becomes zero, and the increase in the voltage of the feedback line 7 stops.

The voltage of the data line 6 immediately before the end of the auto-zero operation (time t3) is substantially a voltage (Vss−Vth) lower than source voltage Vss of the driving transistor 11 by the threshold voltage Vth. Therefore, the voltage of the feedback line 7, that is, voltage Va at the input terminal of the voltage amplifier 17, at this time has a value that satisfies the following expression.

$$Vss-Vth=\alpha Va+V\text{offset} \quad (1)$$

At the same time as the fourth switch 19 is turned off at the time t3, or after the fourth switch 19 is turned off, the output GEN of the data generation circuit 21 is switched from the constant voltage Vref to data voltage Vdata. The data voltage Vdata may be continuously varied from the level of black (B) to the level of white (W) in accordance with the luminescence of the organic EL device 8. By this change in voltage, the voltage at the input terminal of the voltage amplifier 17 changes from Va in the expression (1) by a difference in voltage (Vdata−Vref), and becomes Va+(Vdata−Vref). Therefore, the voltage at the output terminal of the voltage amplifier 17, that is, voltage Vx of the data line 6, may be expressed by the following expression.

$$Vx=\alpha[Va+(V\text{data}-V\text{ref})]+V\text{offset} \quad (2)$$

The following expression may be obtained from the expressions (1) and (2).

$$Vx=(Vss-Vth)+\alpha(V\text{data}-V\text{ref}) \quad (3)$$

This is the value of DATA during the period t3 to t4 illustrated in FIG. 6. Since the fourth switch is turned off, the voltage FB of the feedback line 7 remains unchanged at the value at the time of the end of the auto-zero operation.

When the writing in the n-th row has been completed over the period t1 to t4 as described above, the scan signal SEL[n] of the scan line 4 is reset to the H level, and the scan signal ILM[n] of the light emission control line 5 in the same n-th row switches to the L level. Therefore, current flows into the organic EL device 8 and causes the organic EL device 8 to light. Because the current flowing into the organic EL device 8 may be expressed as $I=\text{const}\times(Vss-Vx-Vth)^2$, current independent of the threshold voltage Vth may be obtained from the expression (3).

When a scan signal SEL2 of the second scan line has been reset to the H level, the organic EL device 8 stops lighting.

In an (n+1)th row and subsequent rows, the write mode and the light-emitting mode are established in the same manner as above.

As indicated by the expression (3), the gate voltage Vx after the end of the data writing is a voltage independent of the offset voltage Voffset. Even if there is variation in offset voltage between the columns, the column control circuit 3 illustrated in FIGS. 1 and 2 automatically compensates the variation, and outputs constant voltage to the data line 6. The reason why the offset variation may be compensated is that the effect of the offset of the voltage amplifier 17 is suppressed by the auto-zero operation and the operation for inputting the data voltage and resetting the output voltage through the coupling capacitor 20. That is, because, in the auto-zero operation, in which the drain voltage of the driving transistor 11 is fed back to the gate voltage, the output voltage of the voltage amplifier 17 is determined by the threshold voltage of the driving transistor 11, the offset is included in the voltage at the input terminal of the voltage amplifier 17. By isolating the feedback loop and applying the data voltage to the input terminal of the voltage amplifier 17 through the coupling capacitor 20 in this state, a voltage independent of the offset appears at the output terminal of the voltage amplifier 17. By determining this voltage as the gate voltage, the light-emitting device 8 may light using current independent of the offset.

In the above description, the transistor 14 (third switch) is turned on in the pre-charge period t1 to t2 in order to cause current to flow into the organic EL device 8. The pre-charging need not necessarily use this method.

Figure 7:
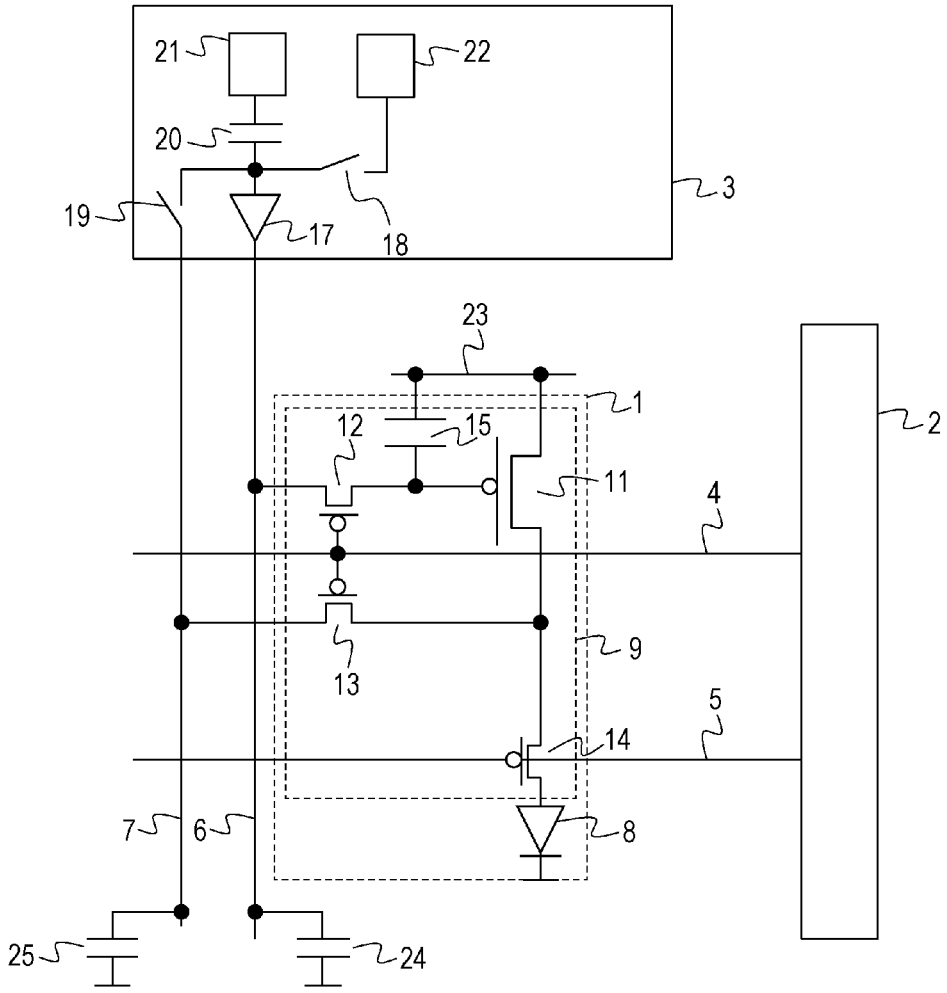
FIG. 7 is a circuit diagram illustrating a modification of the first embodiment.

FIG. 7 illustrates a column control circuit 3 in which a fixed voltage source 22 and a fifth switch 18 are provided. During the pre-charge period, the fifth switch 18 is turned on to apply voltage Vp of the fixed voltage source 22 to a data line 6 and a feedback line 7. The voltage Vp is voltage for making a gate of a driving transistor 11 sufficiently lower than source potential. In doing so, a third switch may be turned off during the pre-charge period in order not to cause current to flow into an organic EL device 8.

Figure 8:
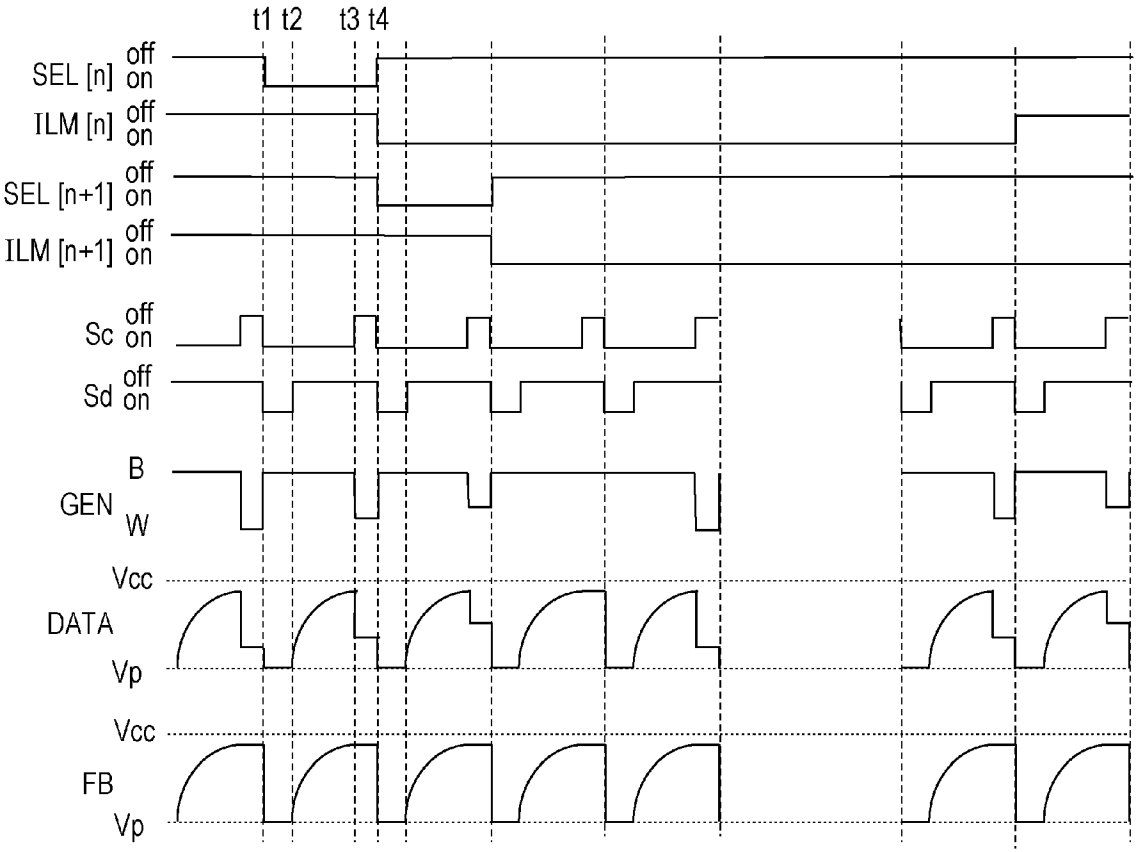
FIG. 8 is a timing chart illustrating the operation of a display apparatus according to the modification of the first embodiment.

FIG. 8 is a timing chart illustrating the operation of a display apparatus illustrated in FIG. 7. A control signal Sd controls the fifth switch 18 to turn on the fifth switch 18 for the pre-charge period t1 to t2. During the pre-charge period, the voltages of the data line 6 and the feedback line 7 are fixed to the voltage Vp. A control signal ILM of the third switch (transistor 14) is at the H level over the pre-charge period to turn off the third switch. The operation after the time t2 is the same as that illustrated in FIG. 6.

A pixel capacitor 15 provided for each pixel may be substituted by a gate-source capacitance of the driving transistor 11. The gate-source capacitance of the driving transistor 11 is parasitic capacitance generated by channel capacitance and an overlap between a gate electrode and a source electrode. Because the data voltage is not held when the parasitic capacitance is too small, a genuine pixel capacitance 15 is provided in this case.

The driving transistor 11 and the other transistors may be p-channel metal-oxide-semiconductor field-effect transistors (MOSFETs) or n-channel MOSFETs. These MOSFETs are formed on a semiconductor substrate such as one composed of silicon. Alternatively, an amorphous semiconductor film may be formed on an insulating substrate.

In the present invention, the auto-zero operation is performed using feedback through the voltage amplifier 17. The voltage amplifier 17 outputs the voltage determined by the voltage of the feedback line 7 to the data line 6. The voltage of the feedback line 7 continues to change insofar as the driving transistor 11 is turned on and current is flowing. When the voltage of the feedback line 7 no longer changes, the gate-source voltage of the driving transistor 11 has reached the threshold voltage. That is, the gate has a voltage lower than the power supply voltage VDD by the threshold voltage at the end of the auto-zero operation.

A non-inverting amplifier that outputs a change in input voltage as a change in the same direction without reversing the polarity is used as the voltage amplifier 17.

When the conductivity type of the driving transistor 11 is a p-type, current flows out of the drain, and therefore the voltage of the feedback line 7 increases and the voltage amplifier 17 outputs an increased voltage. As a result, the gate voltage of the p-type driving transistor 11 changes in an increase direction, that is, in a direction in the p-type driving transistor 11 becomes close to off. When the conductivity type of the driving transistor 11 is an n-type, current flows into the drain, and therefore the voltage of the feedback line 7 decreases and the voltage amplifier 17 outputs a decreased voltage. As a result, the gate voltage of the n-type driving transistor 11 changes in a decrease direction, that is, in a direction in which the n-type driving transistor 11 becomes close to off.

In a normal auto-zero operation, the gate and the drain are short-circuited to each other. In order to perform the same operation as this, the gain of the non-inverting amplifier is set to 1, so that the voltage at the input terminal and the voltage at the output terminal become the same. However, not by setting the gain to 1 but by increasing a change in the voltage of the drain several times and applying the voltage to the gate, the auto-zero operation may be completed in a shorter period of time.

Since the voltage amplifier 17 performs amplification using a gain of 1 or relatively low gain, a stable operation is possible. As illustrated in FIGS. 5A and 5B, even when the voltage amplifier 17 is configured by using an operational amplifier, an operation that is more stable than that of a negative feedback loop using a data line and a feedback line may be obtained by providing a negative feedback loop inside the voltage amplifier 17.

In addition to the display apparatus illustrated in FIG. 1, the present invention may be a driving apparatus for light-emitting devices arranged in a line by extracting only one column illustrated in FIG. 1. Such a driving apparatus is used as an exposure head of an image forming apparatus such as an electrophotographic printer.

Figure 9:
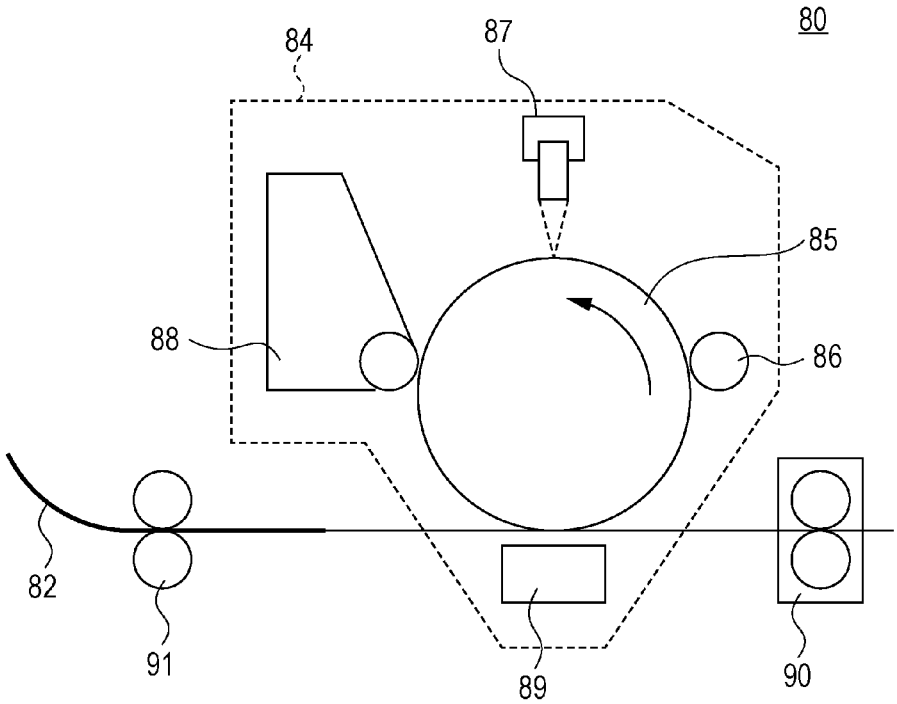
FIG. 9 is a block diagram illustrating the configuration an image forming apparatus according to a second embodiment of the present invention.

FIG. 9 is a diagram illustrating the configuration of an electrophotographic printer 80 according to a second embodiment of the present invention.

A recording unit 84 includes a drum-shaped photosensitive member 85, to a surface of which a photosensitive material is applied, a charger 86, an exposure head 87, a developer 88, and a transfer member 89. The surface of the photosensitive member 85 is charged by the charger 86, and a light-emitting device array (hereinafter referred to as an organic EL array) in the exposure head 87 in which organic EL devices are arranged lights, in order to expose the photosensitive member 85. The amount of light to which the photosensitive member 85 is exposed is controlled by a product of exposure illumination and exposure time. The charge potential of a portion exposed to the light emitted by an organic EL device changes, and toner is applied to the portion while the portion is passing by the developer 88. A sheet 82 is conveyed to the recording unit 84 by a conveying roller 90 provided in the electrophotographic printer 80. The toner applied to the photosensitive member 85 is transferred by the transfer member 89 and fixed by a fixing member 91. The sheet 82 is then discharged, and thus the printing ends.

In the exposure head 87, a large number of organic EL devices are arranged perpendicular to a surface of the sheet 82, that is, perpendicular to a moving direction of the photosensitive member 85, which is indicated by an arrow in FIG. 9. The organic EL devices are formed on a glass substrate along with a driving apparatus therefor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-098112 filed Apr. 23, 2012 and No. 2013-039270 filed Feb. 28, 2013, which are hereby incorporated by reference herein in their entirety.

What is claimed is:

1. A display apparatus comprising:

light-emitting devices and driving circuits for supplying current to the light-emitting devices configured to be arranged in a row direction and a column direction;

data lines and feedback lines configured to be provided for columns of the driving circuits;

a row control circuit configured to control the driving circuits row by row; and a column control circuit configured to supply voltage to the data lines, wherein each of the driving circuits includes a transistor that supplies current to each of the light-emitting devices, a first switch that connects a gate of the transistor and one of the data lines, a second switch that connects a drain or a source of the transistor and one of the feedback lines, and a third switch that connects the drain or the source of the transistor and each of the light-emitting devices, the first, second and third switches being controlled by the row control circuit, and wherein the column control circuit includes a data generation circuit, a non-inverting voltage amplifier whose input terminal is connected to the data generation circuit through a capacitor and output terminal is connected to one of the data lines, and whose voltage at the output terminal is determined by a voltage at the input terminal, and a fourth switch that connects the input terminal of the voltage amplifier and one of the feedback lines.

2. The display apparatus according to claim 1, wherein the row control circuit performs control for each of the driving circuits such that, in a first period, the first to fourth switches are all turned on, such that, in a second period, the first, second, and fourth switches are turned on and the third switch is turned off, and such that, in a third period, the first and second switches are turned on and the third and fourth switches are turned off, and wherein the data generation circuit outputs a constant voltage in the first period and the second period, and output a data voltage corresponding to luminance of the light-emitting devices in the third period.

3. The display apparatus according to claim 1, wherein the voltage amplifier includes an operational amplifier provided with a negative feedback loop.

4. The display apparatus according to claim 3, wherein the voltage amplifier is a voltage follower circuit that uses a positive input of the operational amplifier as an input terminal and that uses a negative input and an output of the operational amplifier as an output terminal by connecting the negative input and the output.

5. The display apparatus according to claim 3, wherein the voltage amplifier is a non-inverting voltage amplifier in which an input terminal is connected to a positive input of the operational amplifier through a first resistor, in which a negative input of the operational amplifier is connected to reference voltage through a second resistor, in which a third resistor is connected between the negative input and an output of the operational amplifier, and in which the output of the operational amplifier is used as an output terminal.

6. The display apparatus according to claim 1, further comprising:

a fifth switch configured to connect the input terminal of the voltage amplifier to a fixed voltage source.

7. A method for driving a light-emitting device that uses a transistor, one of a source and a drain of which is connected to a power source and another of which supplies current to the light-emitting device, and a non-inverting voltage amplifier that outputs voltage determined by voltage at an input terminal, the method comprising:

a first step in which a threshold voltage of the transistor is set between a gate and the source of the transistor by connecting the source or the drain of the transistor that supplies the current to the light-emitting device to an end of a capacitor to supply a current from the transistor to the capacitor and transferring a voltage of the capacitor to the gate of the transistor through the non-inverting voltage amplifier until the current becomes zero;

a second step in which the threshold voltage set between the gate and the source of the transistor is changed according to data voltage by disconnecting the transistor from the one end of the capacitor and applying the data voltage to another end of the capacitor; and a third step in which the light-emitting device is caused to light at luminescence according to the data voltage by connecting the source or the drain of the transistor to the light-emitting device, and supplying the current flowing through the transistor to the light-emitting device.

8. The method for driving a light-emitting device according to claim 7, further comprising:

a step of causing the transistor to enter a conductive state before the first step.

9. A driving apparatus for light-emitting devices, the driving apparatus comprising:

a plurality of transistors configured to be arranged in a row direction and a column direction, each of the plurality of transistors including a source and a drain, one of which is connected to a power supply and another of which supplies current to each of the light-emitting devices;

data lines configured to be provided for the plurality of transistors in the column direction in common and connected to gates of the transistors through first switches;

feedback lines configured to be provided for the plurality of transistors in the column direction in common and connected to the source or the drain of the transistors that supplies the current to each of the light-emitting devices through second switches;

third switches configured to connect the source or the drain of the transistors to the light-emitting devices to supply currents;

a voltage amplifier, an input terminal of which is connected to one of the feedback lines through a fourth switch and an output terminal of which is connected to one of the data lines; and a data generation circuit configured to be connected to the input terminal of the voltage amplifier via a capacitor connected in series, wherein the voltage amplifier is a non-inverting voltage amplifier to transfer a change in voltage at the input terminal to the output terminal without changing polarity, and converts a change in voltage of the corresponding feedback line generated by a current flowing from the transistors to the capacitor through the second switches into a change in voltage of the corresponding data line in a direction in which the transistors connected to the data line through the first switches turn off.

10. The driving apparatus for light-emitting devices according to claim 9, further comprising:

a unit configured to initialize the transistors to a conductive state.

11. An image forming apparatus comprising:

a photosensitive member;

light-emitting devices configured to be arranged perpendicular to a moving direction of the photosensitive member; and the driving apparatus for light-emitting devices according to claim 9 configured to drive the light-emitting devices.

12. A display apparatus comprising:

light-emitting devices configured to be arranged in a row direction and a column direction; and a plurality of driving apparatuses for light-emitting devices, each of which is the driving apparatus for light-emitting devices according to claim 9, configured to be arranged in the row direction and drive the light-emitting devices arranged in the column direction.

* * * * *